US007618268B2

(12) United States Patent
Ko et al.

(10) Patent No.: US 7,618,268 B2
(45) Date of Patent: Nov. 17, 2009

(54) ELECTRICAL CONNECTOR WITH RELIABLE MATING FRAME MATING WITH ANOTHER CONNECTOR

(75) Inventors: David Tso-Chin Ko, Cypress, CA (US); Xue-Yuan Xiao, Kunshan (CN); Shu-Qiang Zhao, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 91 days.

(21) Appl. No.: 11/888,465

(22) Filed: Aug. 1, 2007

(65) Prior Publication Data

US 2008/0171455 A1 Jul. 17, 2008

Related U.S. Application Data

(63) Continuation-in-part of application No. 11/580,608, filed on Oct. 12, 2006, now Pat. No. 7,442,057.

(30) Foreign Application Priority Data

Aug. 1, 2006 (CH) ..... 2006 2 0076133

(51) Int. Cl.
*H01R 4/66* (2006.01)

(52) U.S. Cl. ..... 439/101

(58) Field of Classification Search ..... 439/101, 439/610, 447, 686, 108, 608, 79, 502, 626, 439/680, 607, 541.5, 695, 697, 607.01, 607.02, 439/607.05, 607.08, 607.13, 607.27, 607.31, 439/607.32, 607.53, 607.54, 607.55, 607.48, 439/607.56, 607.42, 607.41, 607.28, 607.07
See application file for complete search history.

(56) References Cited

U.S. PATENT DOCUMENTS

| | | | | |
|---|---|---|---|---|
| 6,007,381 | A | 12/1999 | Ando | |
| 6,508,671 | B2 * | 1/2003 | Ko | 439/610 |
| 6,652,317 | B2 | 11/2003 | Shao | |
| 6,863,549 | B2 * | 3/2005 | Brunker et al. | 439/108 |
| D524,753 | S | 7/2006 | Asakawa | |
| 2005/0048839 | A1 * | 3/2005 | Zhang | 439/607 |

* cited by examiner

*Primary Examiner*—Edwin A. Leon
(74) *Attorney, Agent, or Firm*—Wei Te Chung; Andrew C. Cheng; Ming Chieh Chang

(57) ABSTRACT

An electrical connector (100) includes an insulative housing (1) for receiving a number of contacts (2), and a metal shield (3) enclosing the insulative housing (1). The insulative housing has a rear portion (11) and a pair of arms (12, 17) integrally extending from lateral sides of the rear portion with a receiving space (18) formed therebetween. The rear portion comprises a pair of upper and lower tongue plates (13, 14) extending forwardly into the receiving space with a mating slot (15) formed therebetween. Each contact (2) has a contact portion (2211) extending into the mating slot for electrically connecting with a plug. The metal shield (3) includes a top wall, an opposite bottom wall and a pair of side walls substantially engaging with the pair of arms, wherein the top and bottom walls restrict upper and lower positions of the receiving space (18), respectively.

20 Claims, 7 Drawing Sheets

ELECTRICAL CONNECTOR WITH RELIABLE MATING FRAME MATING WITH ANOTHER CONNECTOR

CROSS-REFERENCE TO RELATED APPLICATIONS

This is a continuation-in-part application of U.S. patent application Ser. No. 11/580,608 filed on Oct. 12, 2006 now U.S. Pat. No. 7,442,057, and relates to a contemporaneously filed application entitled "ELECTRICAL CONNECTOR WITH IMPROVED CONTACTS", and are assigned to the same applicant and the same assignee with the instant invention.

BACKGROUND OF THE INVENTION

1. Field of the Invention

This invention generally relates to an electrical connector, and more particularly to an electrical connector which can reliably mate with a corresponding connector.

2. Description of the Prior Art

U.S. Pat. No. 6,007,381 discloses an electrical connector which includes an insulative housing supporting plural contacts and a metal shield. The insulative housing comprises a rear portion and a tongue plate protruding forwardly from the rear portion with a plurality of passageways defined therein. The contacts comprise a plurality of contact portions received in the passageways and a plurality of soldering portions extending beyond the insulative housing. The metal shield has a rear section engaging with the rear portion of the insulative housing and a front frame enclosing the tongue plate to circumscribe a receiving space therebetween. The front frame which is stamped from a metal sheet and comprises a top wall, a bottom wall and a pair of sidewalls connecting the top and bottom walls. However, it is probable difficult to assure the dimension of the frame, especially the sidewalls because they are relative short. Besides, the stamping process of manufacturing the frame is relatively complex and usually suffers some unsure factors. As a result, the precision of the frame is so low that it can't provide reliably connecting with an inserted mating connector. Further more, the metal shield may not be able to firmly engage with the insulative housing only through its rear section abutting against the rear portion of the insulative housing because the engaging surface therebetween is relative small.

Hence, it is desired to have an electrical connector solving the problem above.

BRIEF SUMMARY OF THE INVENTION

Accordingly, an object of the present invention is to provide an electrical connector with firm configuration and precision frame reliably mating with a corresponding plug.

In order to attain the objective above, an electrical connector comprises an insulative housing, a plurality of contacts retained in the insulative housing and a metal shield enclosing the insulative housing. The insulative housing has a rear portion and a pair of arms integrally extending from opposite lateral sides of the rear portion with a receiving space formed therebetween. The rear portion comprises a pair of upper and lower tongue plates extending forwardly into the receiving space with a mating slot formed between the upper and lower tongue plates. Each contact has a contact portion extending into the mating slot for electrically connecting with a plug. The metal shield includes a top wall, an opposite bottom wall and a pair of side walls substantially engaging with the pair of arms, wherein the top and bottom walls restrict upper and lower positions of the receiving space, respectively. The electrical connector comprises a frame circumscribed by the pair of arms and the top and bottom walls of the metal shield. With this arrangement, the pair of arms integrally protruding from the rear portion can be easily manufactured via ejecting molding to provide precision dimension to ensure the frame reliably mating with a plug. Besides, the side walls of the metal shield substantially engage with the arms so that the metal shield can firmly combine with the insulative housing with larger engaging space.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 1:
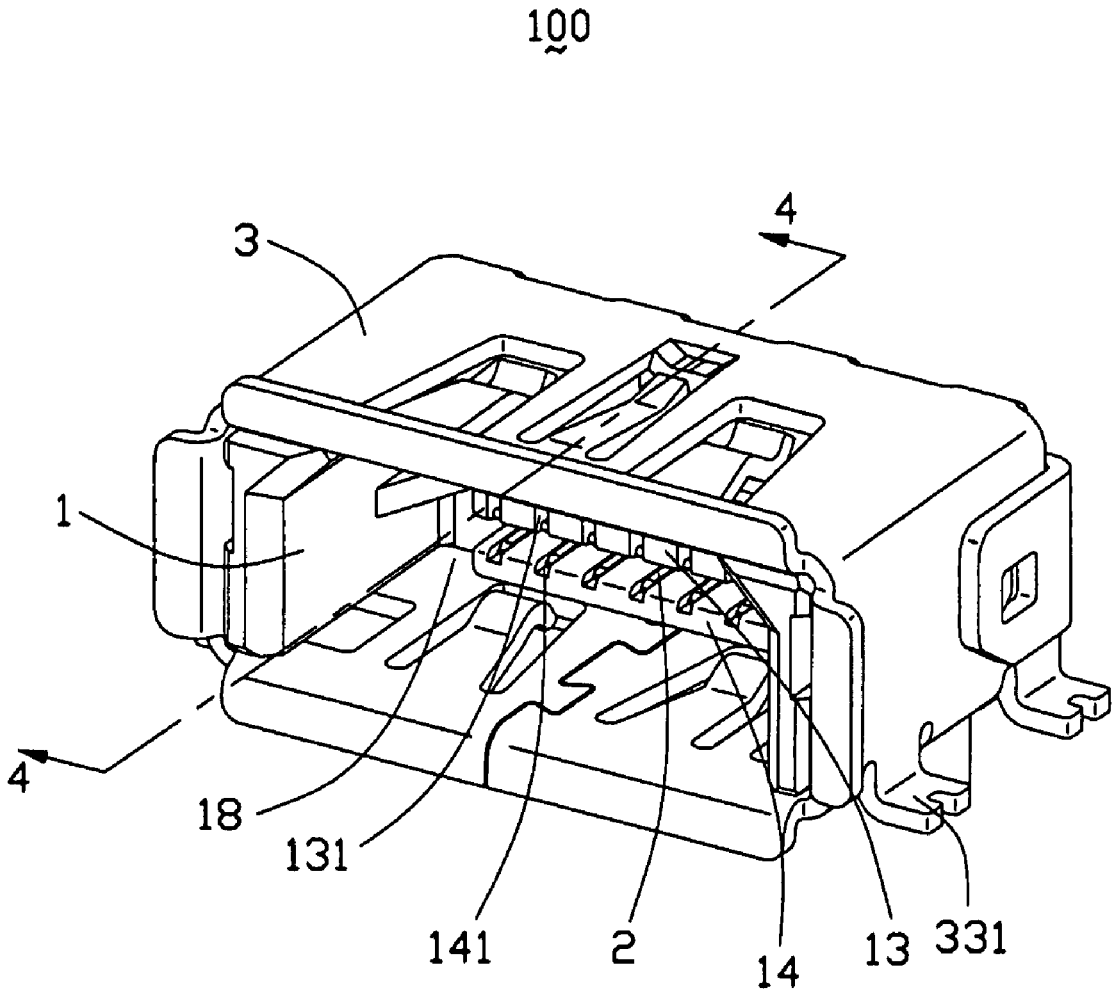
FIG. 1 is a perspective view of an electrical connector according to an embodiment of the present invention.
Figure 2:
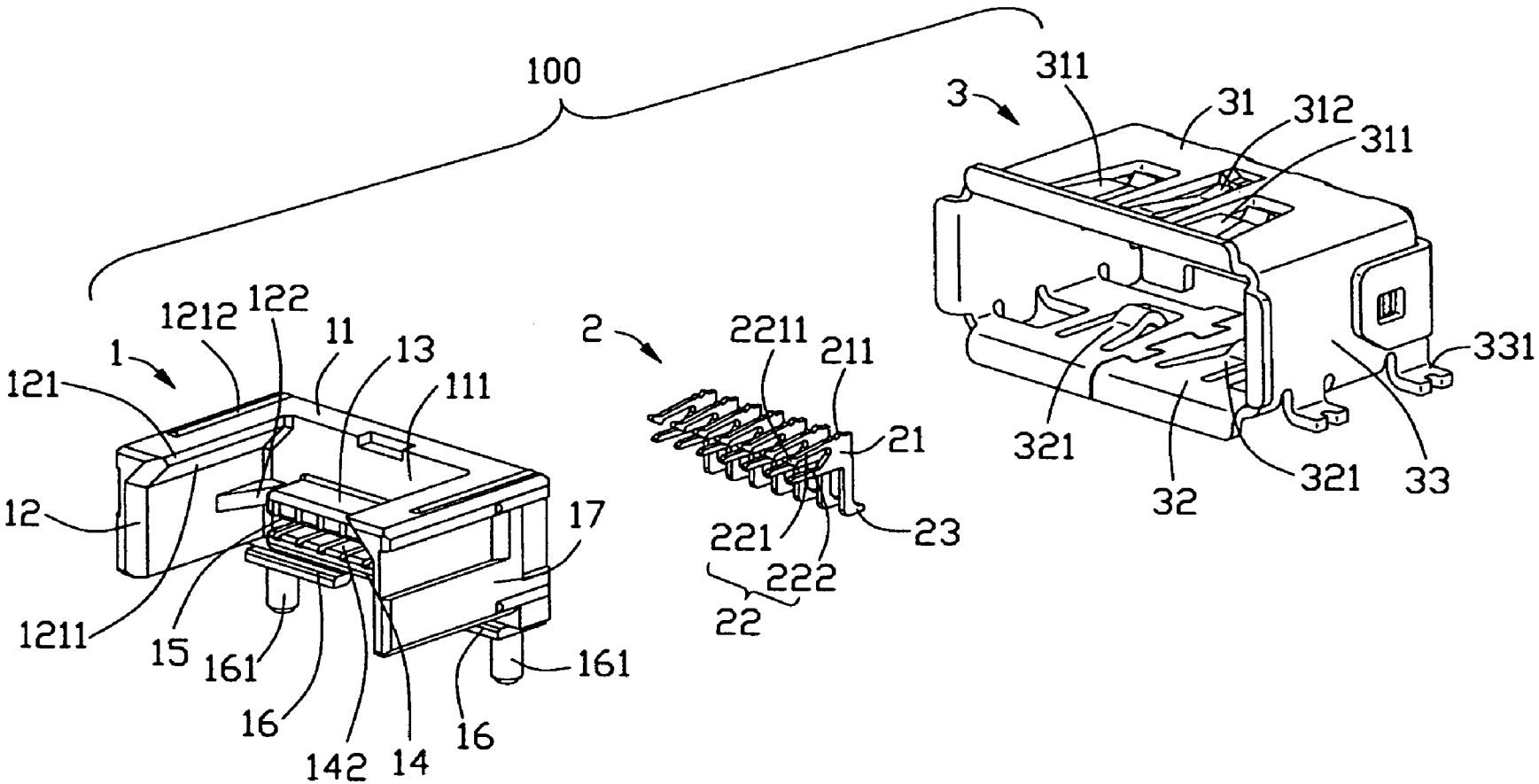
FIG. 2 is an exploded view of the electrical connector shown in FIG. 1.
Figure 3:
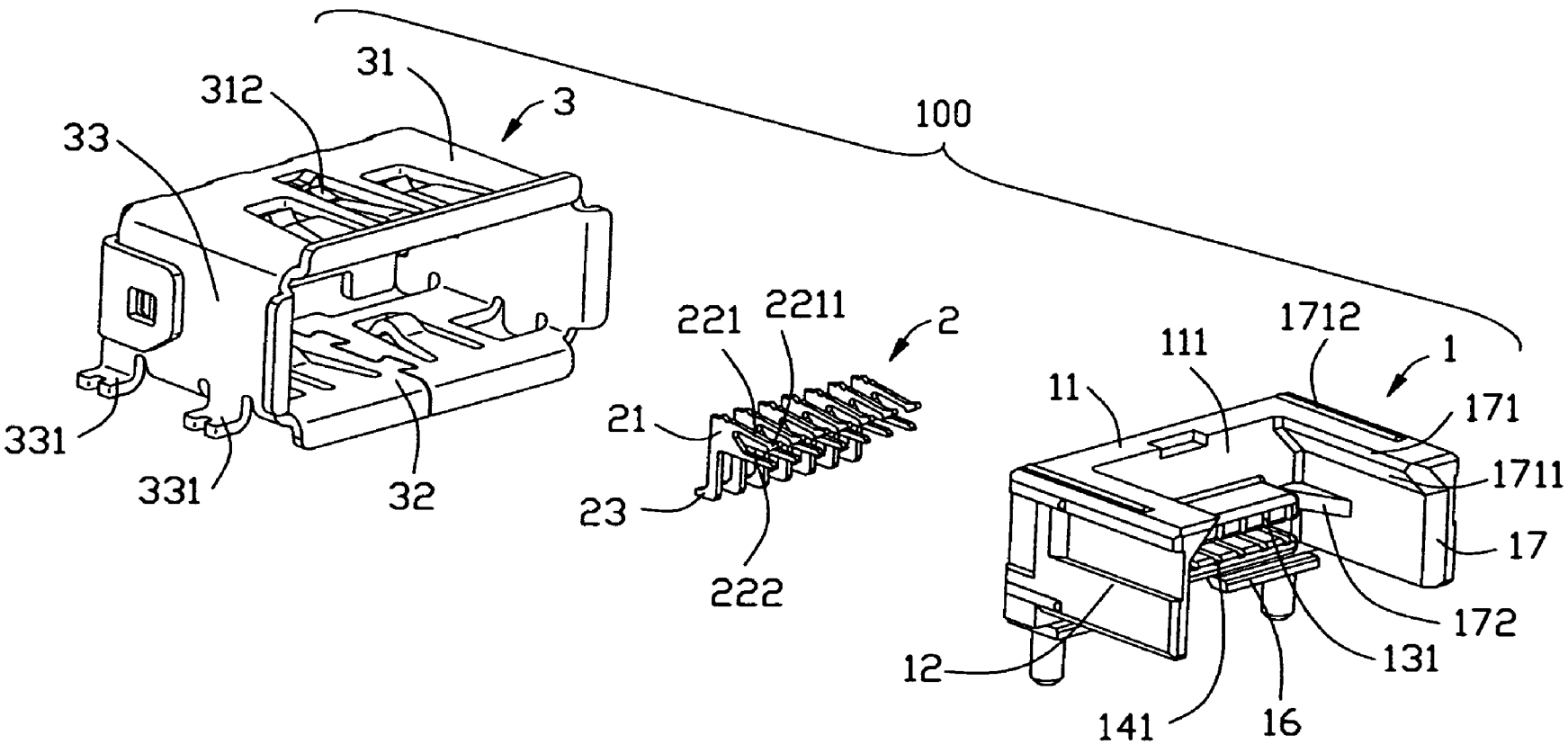
FIG. 3 is similar to FIG. 2, but viewed from another aspect.

Referring to FIGS. 1 to 3, an electrical connector 100 mounted on a printed circuit board 7 (PCB, shown in FIG. 6) for mating with a corresponding plug 200. The electrical connector 100 comprises an insulative housing 1, a plurality of contacts 2 retained in the insulative housing 1 and a metal shield 3 enclosing the insulative housing 1. The electrical connector 100 in the preferred embodiment is a radio frequency (RF) electrical connector.

Figure 4:
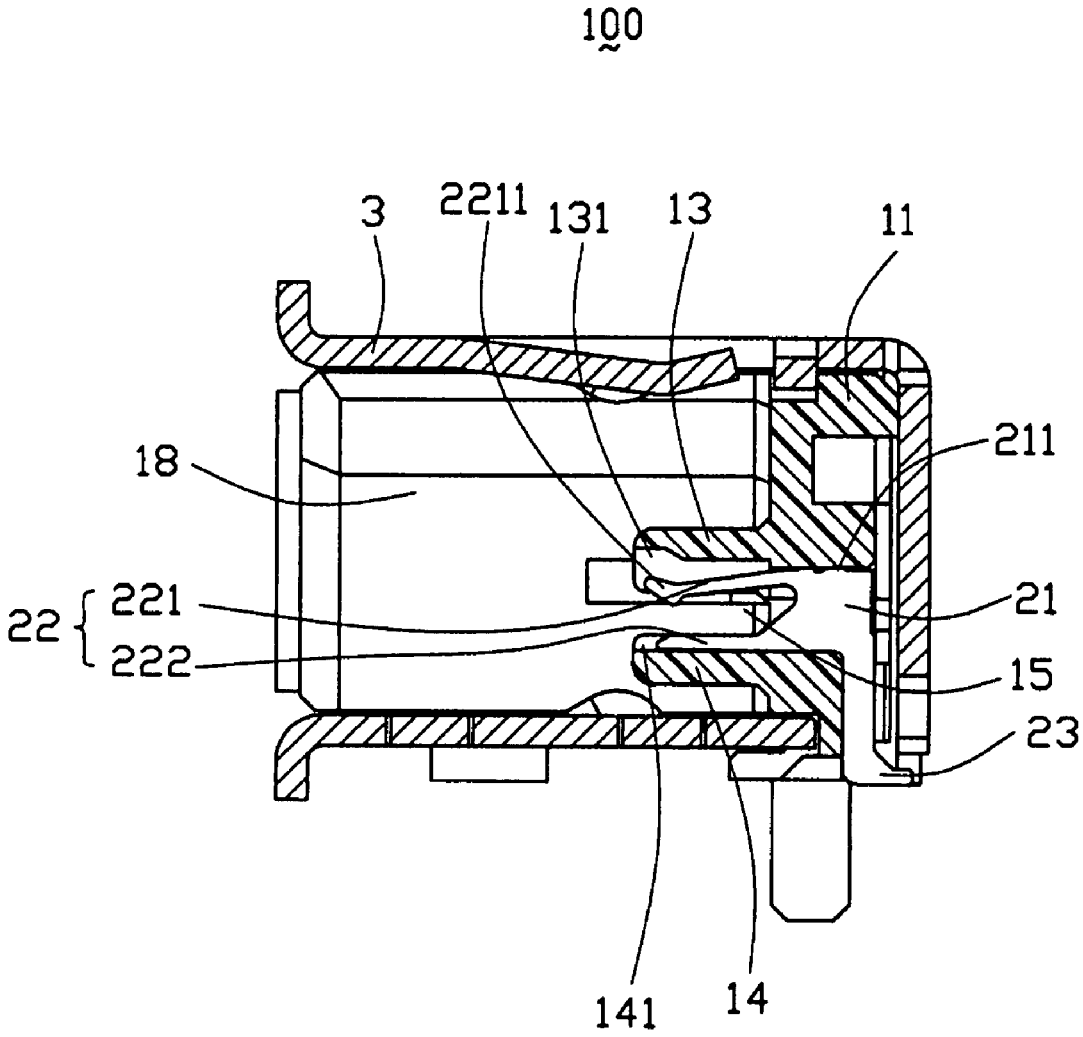
FIG. 4 is a cross sectional view taken along line 4-4 of FIG. 1.

Further referring to FIG. 4 in conjuction with FIGS. 2 and 3, the insulative housing 1 includes a rear portion 11, a first and a second arm 12, 17 cantilevered extending forwardly from opposite lateral sides of the rear portion 11, and a receiving space 18 disposed between the first and second arms 12, 17. The rear portion 11 has a front face 111, a pair of first and second tongue plates 13, 14 integrally projecting forwardly from middle of the front face 111 and extending into the receiving space 18. The first and second tongue plates 13, 14 are probably of the same configuration and disposed parallel to each other. The first and second tongue plates 13, 14 have a distal end (not labeled) disposed nearer to the front face 111 of the rear portion 11 than to a mating surface (not labeled) of the electrical connector as shown in FIG. 4. The first and second tongue plates 13, 14 are aligned with each other along a vertical direction, wherein the first tongue plate 13 is positioned over the second tongue plate 14. A horizontal mating slot 15 is disposed between and separates the first and second tongue plates 13, 14. The first and second tongue plates 13, 14 respectively define a plurality of first and second passageways 131, 141 for receiving the contacts 2 therein. The first passageways 131 are aligned with corresponding second passageways 141 in the vertical direction. The second tongue plate 14 has a guiding face 142 with the second passageways 141 recessed therein. The rear portion 11 has a plurality of mounting holes (not labeled) respectively communication with the first and second passageways 131, 141 for the contacts 2 assembled through the mounting holes. The rear portion 11 further has a pair of engaging plates 16 on a lower position thereof for abutting against the metal shield 3. Each engaging plate 16 has a post 161 receivable in a hole (not shown) of the PCB 7 for fixing the electrical connector on the PCB 7. A pair of triangle-shaped wedges 122, 172 are formed on opposite inner surfaces of the first and second arms 12, 17. The wedges 122, 172 connect with the front face 111 of the rear portion 11 to enhance a reliable configuration of the insulative housing 1 for mating with the corresponding plug 200. The wedges 122, 172 are respectively located adjacent to the opposite lateral sides of the tongue plates 13, 14. The first and second arms 12, 17 comprise a pair of upper wing protrusions 121, 171 which face to each other and extend inwardly into the receiving space 18. The wing protrusions 121, 171 and the wedges 122, 172 are adapted for preventing improper connectors inserted into the electrical connector 100. Besides, the wing protrusions 121, 171 respectively define a slant wall 1211, 1711 communicating with the receiving space 18 and a rib 1212, 1712 on upper surfaces thereof for enhancing the connection with the metal shield 3. The slant walls 1211, 1711 are adapted for guiding the corresponding plug 200 smoothly inserted into the electrical connector 100.

The contacts 2 are stamped from a metal sheet and mainly located in a vertical plane. Each contact 2 is Z-shaped and comprises a flat body portion 21, a forked portion 22 extending forwardly from a first end of the body portion 21, and a horizontal soldering tail 23 extending rearwardly from a second end of the body portion 21 to be surfaced mounted to the PCB 7. The forked portion 22 includes an upper and a lower sections 221, 222 respectively received in the first and second passageways 131, 132. An upper surface of the lower section 222 is coplanar with the guiding face 142 for easily insertion of the plug 200. The upper section 221 has a contact portion 2211 at a distal end thereof and extending into the mating slot 15. The body portion 21 further has a plurality of barbs 211 for interference engaging with the first passageways 131.

The metal shield 3 includes a top wall 31, an opposite bottom wall 32, a pair of side walls 33 connecting the top and bottom walls 31, 32, and a rear wall (not labeled) connecting the rear edge of the top wall 31 and cooperating with the pair of side walls 33. The top and bottom walls 31, 32 respectively have a pair of engaging fingers 311, 321 stamped therefrom and slantly extending into the receiving space 18 for mating with the plug 200. The top wall 31 further includes a grounding finger 312 disposed between the corresponding engaging fingers 311. The grounding finger 312 is substantially narrower and longer than the engaging fingers 311 of the top wall 31. The grounding finger 312 comprises a free end located nearer to the rear edge of the top wall 31 than those of the engaging fingers 311. The side walls 33 further include a pair of soldering portions 331 extending outwardly to be soldered to the PCB 7.

Figure 5:
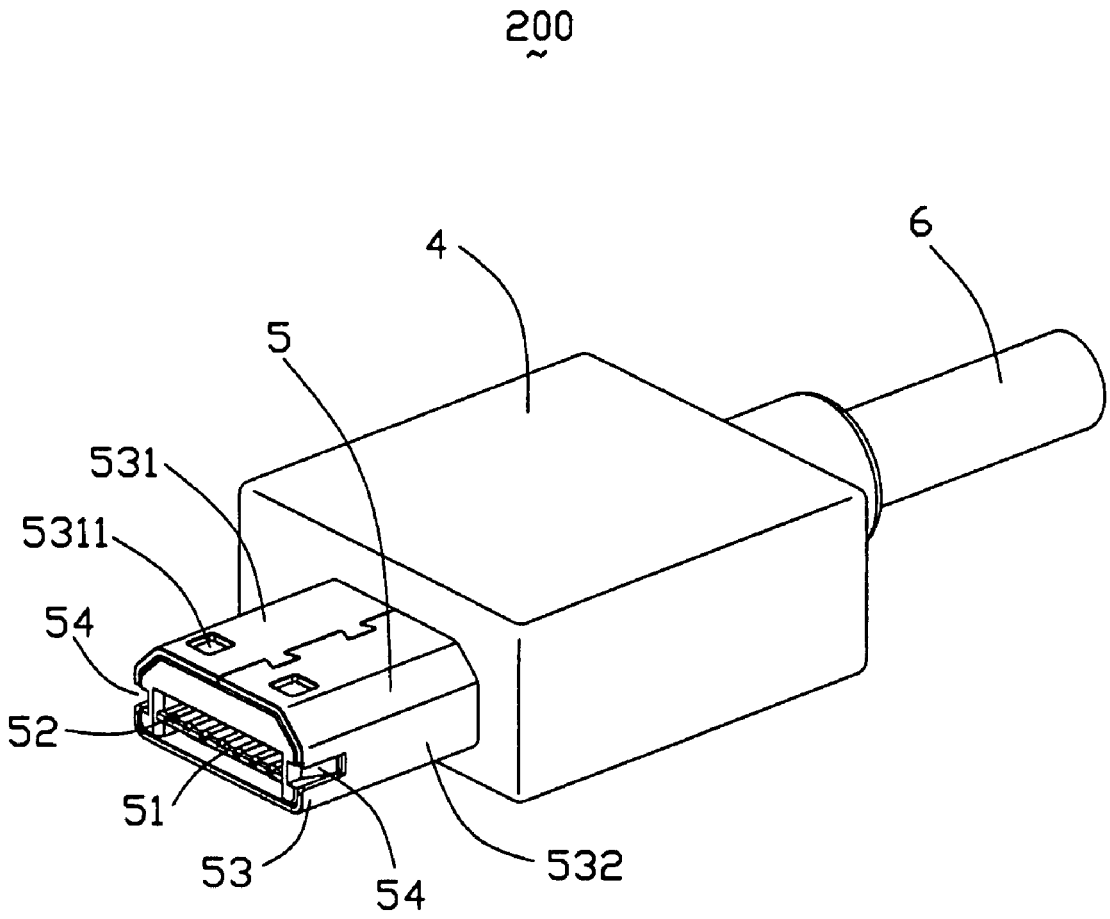
FIG. 5 is a perspective view of a corresponding plug for mating with the electrical connector.

Referring to FIG. 5, the plug 200 includes an insulator 4, a mating portion 5 protruding forwardly from the insulator 4 and a cable 6 electrically connecting the mating portion 5. The upper portion of the mating portion 5 is partially cut to form a pair of inclined edges for mating with the slant walls 1211, 1711 of the wing protrusions 121, 171. The mating portion 5 comprises a tongue portion 51, a plurality of pads 52 supported on the tongue portion 51 and a rectangle-shaped shell 53 enclosing the tongue portion 51. The shell 53 comprises a top wall 531, an opposite bottom wall and a pair of side walls 532. An upper and a lower chamber (not labeled) is provided between the shell 53 and the tongue portion 51 to receive the upper and lower tongue plates 13, 14. The top wall 531 defines a couple of engaging holes 5311 for mating with the corresponding engaging fingers 311. Each side wall 532 defines an inclined depress 54 extending inwardly thereof for receiving the wedges 122, 172.

Figure 6:
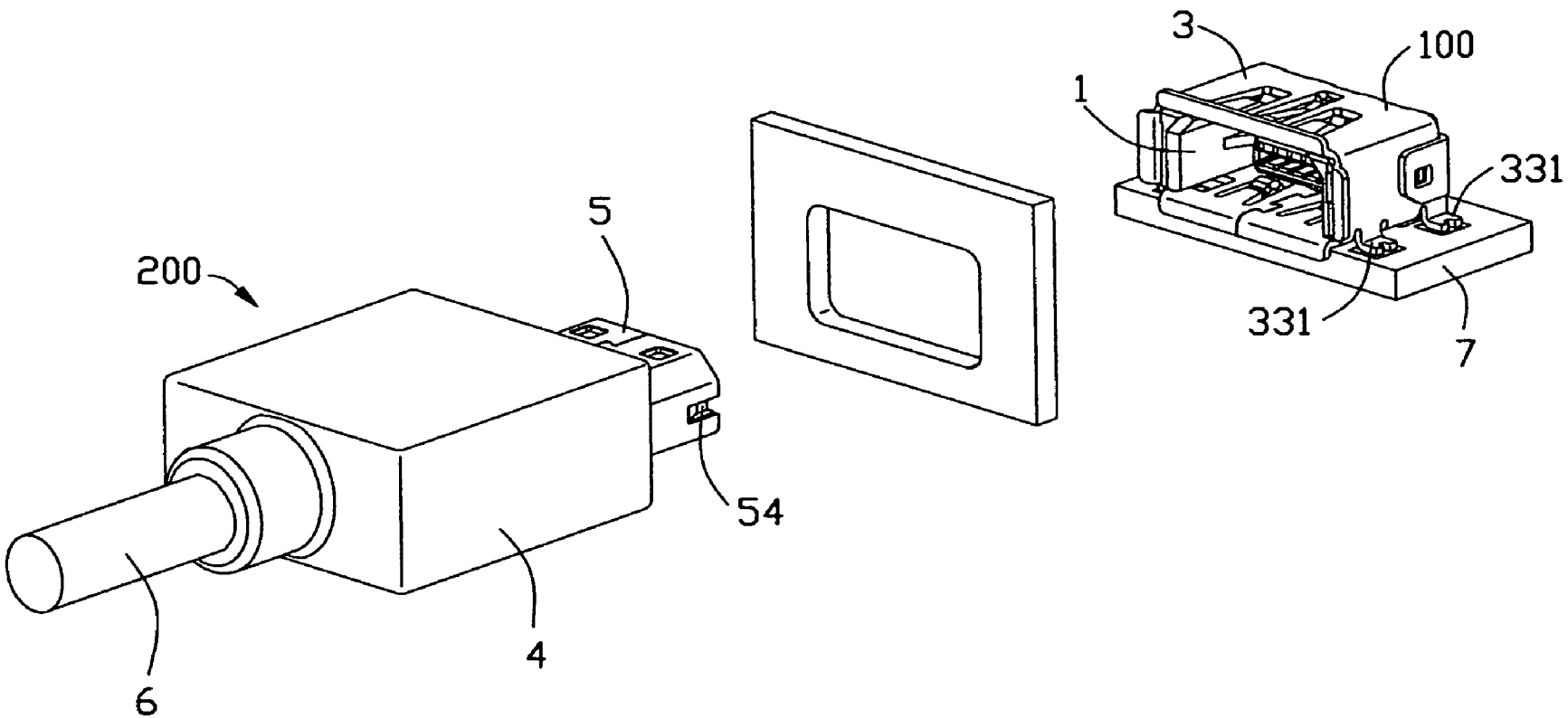
FIG. 6 is a perspective view of an electrical connector assembly before mating the corresponding plug with the electrical connector.
Figure 7:
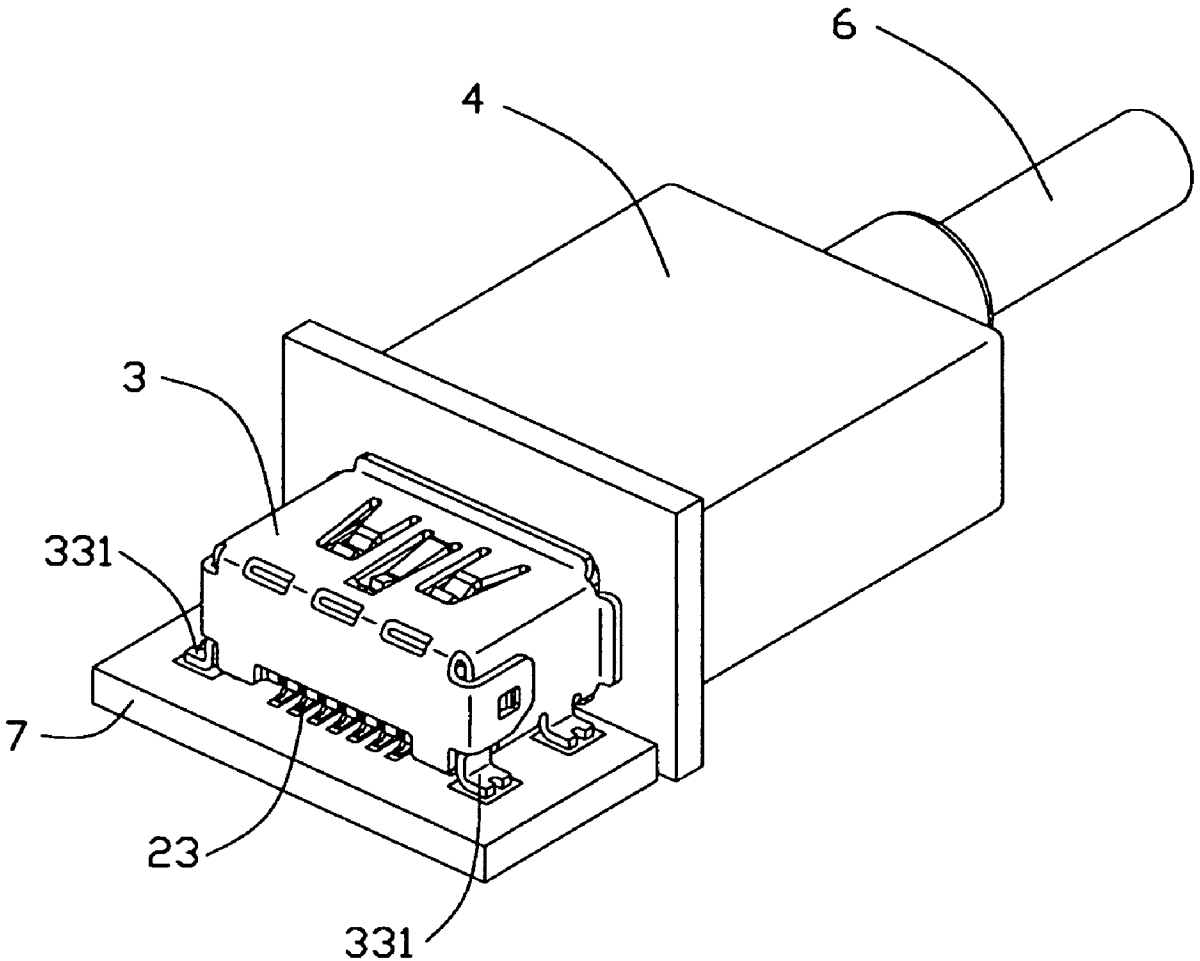
FIG. 7 is a perspective view of the electrical connector assembly of the electrical connector and the plug.

Referring to FIGS. 6 and 7, when the plug 200 is inserted into the electrical connector 100, the mating portion 5 is received in the receiving space 18 and the tongue portion 51 is inserted into the mating slot 15. The wedges 122, 172 of the first and second arms 12, 17 are accommodated in the depresses 54. The upper sections 221 of the contacts 2 are elastically deformed in the first passageways 131 to electrically connecting with the pads 52 for transmitting RF signals received by an antenna to the PCB 7.

Comparing with the prior art, the electrical connector 100 comprises a mating end opposite to the rear portion 11 with a frame circumscribed by the pair of first and second insulative arms 12, 17 and the top and bottom walls 31, 32. The first and second arms 12, 17, which integrally protrude from the rear portion 11, can be easily manufactured through ejecting molding with precision dimension to ensure the frame reliably mating with the plug 200. Besides, the side walls 33 of the metal shield 3 substantially engage with the prolonged first and second arms 12, 17 so that the metal shield 3 can firmly combine with the insulative housing 1 with larger engaging space.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising:

an insulative housing having a rear portion and a pair of arms extending from lateral sides of the rear portion, a receiving space being commonly defined by the rear portion together with the pair of arms for receiving a complementary connector, the rear portion having a pair of upper and lower tongue plates extending forwardly from a front face thereof and extending into the receiving space, a mating slot being formed between the upper and lower tongue plates, the upper tongue plate defining a plurality of first passageways communicating with the mating slot;

a plurality of contacts received in the upper tongue plate and comprising a plurality of elastic contact portions disposed in the first passageways and further protruding into the mating slot under a condition that the contact portions are deformable in the first passageways; and a metal shield enclosing the insulative housing and comprising a top wall, a bottom wall and a pair of side walls engaging with the pair of arms, the top and bottom walls communicating with the receiving space.

2. The electrical connector according to claim 1, wherein the top and bottom walls restrict upper and lower positions of the receiving space, respectively; and the pair of arms are located at inner sides of the pair of side walls.

3. The electrical connector according to claim 1, wherein the electrical connector comprises an insertion surface opposite to the rear portion for insertion of the complementary connector, the upper and lower tongue plates each having a distal end nearer to the front face than to the insertion surface.

4. The electrical connector according to claim 1, wherein the arms comprise a pair of enlarged upper protrusions facing to each other and extending inwardly into the receiving space.

5. The electrical connector according to claim 1, wherein the the upper and the lower tongue plates are rectangular shaped.

6. The electrical connector according to claim 1, wherein the top wall of the metal shield comprises a pair of engaging fingers and a grounding finger located between the pair of engaging fingers, and wherein the grounding finger is substantially narrower than those of the engaging fingers.

7. The electrical connector according to claim 1, wherein each enlarged upper protrusion comprises a slant inner wall communicating with the receiving space for guiding right insertion of the complementary connector.

8. The electrical connector according to claim 1, wherein each arm comprises a wedge formed on inner surface thereof, the wedge being located at the rear of the receiving space and comprising an inclined surface exposed to the receiving space.

9. The electrical connector according to claim 8, wherein the wedge connects with the rear portion and further extends forwardly beyond distal ends of the upper lower tongue plates.

10. The electrical connector according to claim 1, wherein the lower tongue plate defines a plurality of second passageways aligned with the corresponding first passageways in a vertical direction, the contacts each comprising a body portion retained in the rear portion and a forked portion extending from the body portion with each contact portion acting as one branch, the forked portion further comprising a lower portion received in the corresponding second passageway and acting as the other branch.

11. The electrical connector according to claim 10, wherein the lower tongue plate comprises a guiding face with the plurality of second passageways recessed therefrom.

12. An electrical connector assembly, comprising:

an electrical connector and a plug mating with the electrical connector, the electrical connector comprising:

an insulative housing defining a rear portion and a pair of arms extending from lateral sides of the rear portion with a receiving space formed therebetween to receive the plug, the rear portion having a pair of upper and lower tongue plates extending forwardly from a front face thereof and extending into the receiving space, a mating slot being formed between the upper and lower tongue plates;

a plurality of contacts received in the upper tongue plate and comprising a plurality of contact portions protruding into the mating slot; and a metal shield enclosing the insulative housing and comprising a top wall, an opposite bottom wall and a pair of side walls engaging with the pair of arms under a condition that the pair of arms are respectively located at inner sides of the pair of side walls, the top and bottom walls communicating with the receiving space;

the plug comprising:

an insulator; and a mating portion protruding from the insulator, the mating portion comprising a tongue portion wit a plurality of conductive elements supported thereon and a shell enclosing the tongue portion and the conductive elements, an upper and a lower chamber being provided between the shell and the tongue portion to receive the upper and lower tongue plates, the tongue portion being received in the mating slot with the plurality of conductive elements electrically connecting the contact portions of the contacts.

13. The electrical connector assembly according to claim 12, wherein the arms comprise a pair of wedges on opposite inner surfaces thereof, the mating portion defining a pair of depresses mating with the pair of wedges which project into the receiving space.

14. The electrical connector assembly according to claim 12, wherein the electrical connector comprises an insertion surface opposite to the rear portion for insertion of the plug, the upper and lower tongue plates each having a distal end nearer to the front face than to the insertion surface.

15. The electrical connector assembly according to claim 12, wherein the arms comprise a pair of enlarged upper protrusions facing to each other and extending inwardly into the receiving space, each protrusion having an inclined wall on an inner side thereof, and the mating portion of the plug having corresponding inclined edges configured to the slant wall.

16. An electrical connector assembly comprising:

an insulative housing including a rear wall and two side walls commonly defining a receiving space;

a mating port formed in the receiving space with a pair of first and second parallel tongue plates protruding into the receiving space;

a plurality of contacts disposed in the housing with elastic contacting sections positioned in the first and the second tongue plates, the elastic contacting sections being deformable in the first and the second tongue plates; and a metallic shell enclosing said housing and including opposite top and bottom walls with engaging fingers extending into the receiving space.

17. The electrical connector assembly as claimed in claim 16, wherein the first and the second tongue plates integrally extends from the rear wall while spaced from the two side walls, and front edges of the first and the second tongue plates are far spaced from front edge sections of the side walls in a front-to-back direction and protectively hidden in said receiving space.

18. The electrical connector assembly as claimed in claim 16, further including a complementary connector mated with the connector and defining another mating portion circumferentially engaged with the opposite top and bottom walls and the opposite side walls.

19. The electrical connector assembly as claimed in claim 18, wherein a pair of wedges are formed at two opposite corners on an innermost side of said receiving space, and a pair of tapered recesses formed in two opposite sides of said complementary connector for coupling to said pair of wedges.

20. The electrical connector assembly as claimed in claim 18, wherein said another mating portion includes a tongue portion having two opposite fixed lateral ends joined with said mating portion and received between said first and second tongue plates and having conductive pads thereon to be mechanically and electrically engaged with the contacts, respectively.

* * * * *